US006624838B2

(12) United States Patent
Sekiya et al.

(10) Patent No.: US 6,624,838 B2
(45) **Date of Patent: *Sep. 23, 2003**

(54) SEMICONDUCTOR-CHIP CONTROL APPARATUS AND CONTROL METHOD AND IMAGE RECORDING APPARATUS AND ITS CONTROL METHOD

(75) Inventors: Toshiyuki Sekiya, Mishima (JP); Mitsuo Shiraishi, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,836

(22) Filed: May 21, 1999

(65) Prior Publication Data

US 2003/0090561 A1 May 15, 2003

(30) Foreign Application Priority Data

May 29, 1998 (JP) ..... 10-149011

(51) Int. Cl.[7] ..... B41J 2/435
(52) U.S. Cl. ..... 347/237; 347/247
(58) Field of Search ..... 347/237, 238, 347/247, 130, 132; 438/573, 584, 599, 617; 257/113, 175; 327/544; 395/750.03; 365/227; 358/300

(56) References Cited

U.S. PATENT DOCUMENTS

| | | | | |
|---|---|---|---|---|
| 4,733,127 A | | 3/1988 | Takasu et al. | 313/500 |
| 4,779,108 A | | 10/1988 | Inoue | 347/238 |
| 4,933,772 A | * | 6/1990 | Ikenoue et al. | 358/300 |
| 5,307,089 A | | 4/1994 | Takasu et al. | 347/238 |
| 5,656,928 A | | 8/1997 | Suzuki et al. | 324/71.1 |
| 5,781,062 A | * | 7/1998 | Mashiko et al. | 327/544 |
| 5,814,841 A | * | 9/1998 | Kusuda et al. | 257/113 |
| 6,108,018 A | * | 8/2000 | Narita et al. | 347/132 |

FOREIGN PATENT DOCUMENTS

| | | | |
|---|---|---|---|
| EP | 0 335 553 | 10/1989 | |
| EP | 0 364 077 | 4/1990 | |
| JP | 54-084971 | 7/1979 | |
| JP | 01-238962 | 9/1989 | |
| JP | 02-208067 | 8/1990 | |
| JP | 02-212170 | 8/1990 | |
| JP | 03-020457 | 1/1991 | |
| JP | 03-194978 | 8/1991 | |
| JP | 04-005872 | 1/1992 | |
| JP | 04-023367 | 1/1992 | |
| JP | 04-296579 | 10/1992 | |
| JP | 5-299305 | * 11/1993 | H01G/9/04 |

* cited by examiner

*Primary Examiner*—Hai Pham
(74) *Attorney, Agent, or Firm*—Fitzpatrick, Cella, Harper & Scinto

(57) ABSTRACT

To prevent an electrical short due to ion movement in a semiconductor chip and improve the reliability. In a predetermined period T2 in which light-emitting or transfer operation is not performed by light-emitting elements, control signals $\phi 1$, $\phi 2$, $\phi I$, and $\phi S$ and a signal $\phi m$ of a negative-electrode-side power-supply input unit are set to a potential or high-impedance state same as that of a positive-electrode-side power-supply input unit.

23 Claims, 10 Drawing Sheets

SEMICONDUCTOR-CHIP CONTROL APPARATUS AND CONTROL METHOD AND IMAGE RECORDING APPARATUS AND ITS CONTROL METHOD

BACKGROUND OF THE INVENTION

1. Field of the Invention

The present invention relates to a control apparatus for controlling a semiconductor chip such as an LED array used as a recording light-emitting element, moreover to an image recording apparatus for forming a visible image on a recording medium through an electrophotographic recording system by using the semiconductor chip.

2. Related Background Art

A self-scanning LED array (hereafter referred to as SLED) has been used so far as a recording light-emitting element.

The self-scanning LED array is disclosed in Japanese Patent Application Laid-Open Nos. 1-238962, 2-208067, 2-212170, 3-20457, 3-194978, 4-5872, 4-23367, 4-296579, and 5-84971, JAPAN HARD COPY, proposal of optical-printer light-emitting array constituted by integrating 91 (A-17) driving circuit, and proposal of self-scanning light-emitting element (SLED) using the PNPN thyristor structure of IEICE (Institute of Electronics, Information and Communication Engineers), Mar. 5, 1990, and noticed as a recording light-emitting element. The configuration of an SLED array head will be described below.

FIG. 8 shows a schematic configuration of the SLED array head.

Symbol 211 denotes an SLED semiconductor chip. Symbol 212 denotes a base substrate for mounting the SLED semiconductor chip 211, which is configured by a printed circuit board made of glass epoxy or ceramic. Symbol 214 denotes a driver IC for receiving a control signal from an external unit to generate a driving signal for the SLED semiconductor chip 211.

Symbol 215 denotes a bonding wire for connecting output signals supplied from the driver IC 214 ($\phi 1$, $\phi 2$, $\phi S$, and $\phi I$) and a negative-electrode-side power-supply input (GND as for this embodiment) to the SLED semiconductor chip 211 respectively. Symbol 216 denotes a positive-electrode (+) power-supply pattern extended to the base substrate 212 (+5V as for this embodiment). Symbol 217 denotes silver paste for electrically connecting and bonding the positive-electrode-side power-supply pattern 216 extended to the base substrate 212 with the back-face electrode of the SLED semiconductor chip 211 to fix them.

The SLED semiconductor chip 211 frequently uses a method of using the substrate of a chip as an anode because anodes of a light-emission thyristor and a transfer thyristor both serve as a common line and thereby, serve a maximum operating-current route and due to electrical characteristics of P and N of a semiconductor (generally, GaAs semiconductor is used) and problems on fabrication process.

When using a method of using the substrate of a semiconductor chip as a power-supply input unit and connecting the back-face electrode of the semiconductor chip with the power-supply pattern of a base substrate by a conductive adhesive and fixing them, it is inevitable to use a material containing positive (+) metal ions (e.g. silver paste) in order to select a low-resistance material of a predetermined level as the conductive adhesive.

As for the SLED semiconductor chip 211 described above, however, a substrate normally serves as a positive electrode. The substrate is electrically connected with the power-supply pattern 216 of the base substrate 212 by the silver paste 217 through a back-face electrode or the like.

Therefore, an electric-field configuration is formed in which positive ions in the substrate-side silver paste 217 (conductive adhesive) are attracted to the epitaxial-layer side through a chip-side face or the like at a portion serving as a negative electrode in the signal input unit of the epitaxial-layer-side face of the SLED semiconductor chip 211 configuring as a circuit opposite to the substrate-side face of the SLED semiconductor chip 211. The distance between the signal input unit on the epitaxial-layer-side face and the silver paste 217 at the substrate side is approximately 600 $\mu$m.

The attracted positive ions are deposited through reaction with other impurity ions. Therefore, if the deposition reaction continuously occurs, a short circuit is formed between the epitaxial-layer and the substrate due to reasonable elapse of time and thereby, the original operation of an SLED can not be performed.

Therefore, it is an object of the present invention to provide a high-reliability driving controller and image recording apparatus capable of preventing the probability of short circuits formed between electrodes.

SUMMARY OF THE INVENTION

It is an object of the present invention to solve the above problems.

That is, the present invention provides a control apparatus for controlling a semiconductor chip provided with an electrode on its back face and other faces and having a recording element to drive the recording element by connecting the electrode on the back face of the semiconductor chip to a base substrate by a conductive adhesive and inputting a power supply and a control signal to the semiconductor chip from the electrodes on the back face and other faces of the semiconductor chip, which comprises means for controlling portions between the electrode on the back face and the electrodes on the other faces of the semiconductor chip to a high impedance or the same potential in a predetermined period in which the recording element is not driven.

Moreover, the present invention provides a control apparatus for controlling a semiconductor chip provided with an electrode on its back face and other faces by connecting the electrode on the back face of the semiconductor chip to a base substrate by a conductive adhesive and inputting a power supply and a control signal to the semiconductor chip from the electrodes on the back face and other faces of the semiconductor chip, which comprises means for setting portions between the electrode on the back face and the electrodes on the other faces of the semiconductor chip to a high impedance or the same potential in a predetermined period in which the semiconductor chip is not driven.

Furthermore, the present invention provides an image recording apparatus for controlling a semiconductor chip provided with an electrode on its back face and other faces and having a recording element and recording an image on a recording medium to drive the recording element by connecting the electrode on the back face of the semiconductor chip to a base substrate by a conductive adhesive and inputting a power supply and a control signal to the semiconductor chip from the electrodes on the back face and other faces of the semiconductor chip, which comprises means for controlling portions between the electrode on the back face and the electrodes on the other faces of the semiconductor chip to a high impedance or the same potential in a predetermined period in which the recording element is not driven.

Furthermore, the present invention provides a control method for controlling a semiconductor chip provided with an electrode on its back face and other faces and having a recording element to drive the recording element by connecting the electrode on the back face of the semiconductor chip to a base substrate by a conductive adhesive and inputting a power supply and a control signal to the semiconductor chip from the electrodes on the back face and other faces of the semiconductor chip, which comprises the step of controlling portions between the electrode on the back face and the electrodes on the other faces of the semiconductor chip to a high impedance or the same potential in a predetermined period in which the recording element is not driven.

Furthermore, the present invention provides a control method for controlling a semiconductor chip provided with an electrode on its back face and other faces by connecting the electrode on the back face of the semiconductor chip to a base substrate by a conductive adhesive and inputting a power supply and a control signal to the semiconductor chip from the electrodes on the back face and other faces of the semiconductor chip, which comprises the step of setting portions between the electrode on the back face and the electrodes on the other faces of the semiconductor chip to a high impedance or the same potential in a predetermined period in which the semiconductor chip is not driven.

Furthermore, the present invention provides an image recording apparatus control method for controlling a semiconductor chip provided with an electrode on its back face and other faces and having a recording element and recording an image on a recording medium to drive the recording element by connecting the electrode on the back face of the semiconductor chip to a base substrate by a conductive adhesive and inputting a power supply and a control signal to the semiconductor chip from the electrodes on the back face and other faces of the semiconductor chip, which comprises the step of controlling portions between the electrode on the back face and the electrodes on the other faces of the semiconductor chip to a high impedance or the same potential in a predetermined period in which the recording element is not driven.

Other objects, configurations, and advantages of the present invention will become more apparent from the following detailed description when taken in conjunction with the accompanying drawings.

DETAILED DESCRIPTION OF THE PREFERRED EMBODIMENTS

The present invention will be described below in detail by referring to the accompanying drawings.

[Outline]

First, the outline of the present invention will be described.

As for the preferred embodiments, a control signal input unit (control signals $\phi$1, $\phi$2, $\phi$S, and $\phi$I) and a negative-electrode-side power-supply input unit (negative-electrode-potential on/off control signal $\phi$m) are fixed to a potential or high-impedance state same as that of a positive-electrode-side power-supply input unit (power-supply voltage of +5V) in a predetermined period in which light-emitting operation or transfer operation is not performed by an LED (Light-Emitting Diode) array.

Moreover, as for the preferred embodiments, a control signal input unit (control signals $\phi$1, $\phi$2, $\phi$S, and $\phi$I), a positive-electrode-side power-supply input unit (positive-electrode potential on/off control signal $\phi$p), and a negative-electrode-side power-supply input unit (GND) are fixed to the same potential or high-impedance state in a predetermined period in which the light-emitting operation or transfer operation is not performed by an LED array.

Specific examples will be described below.

[First embodiment]

The first embodiment of the present invention will be described below by referring to FIGS. 1 to 5. However, the description of a portion same as that of a conventional example is omitted and the portion is provided with the same symbol.

(Configuration)

A schematic configuration of the first embodiment will be described by referring to FIGS. 1 to 3.

Figure 1:
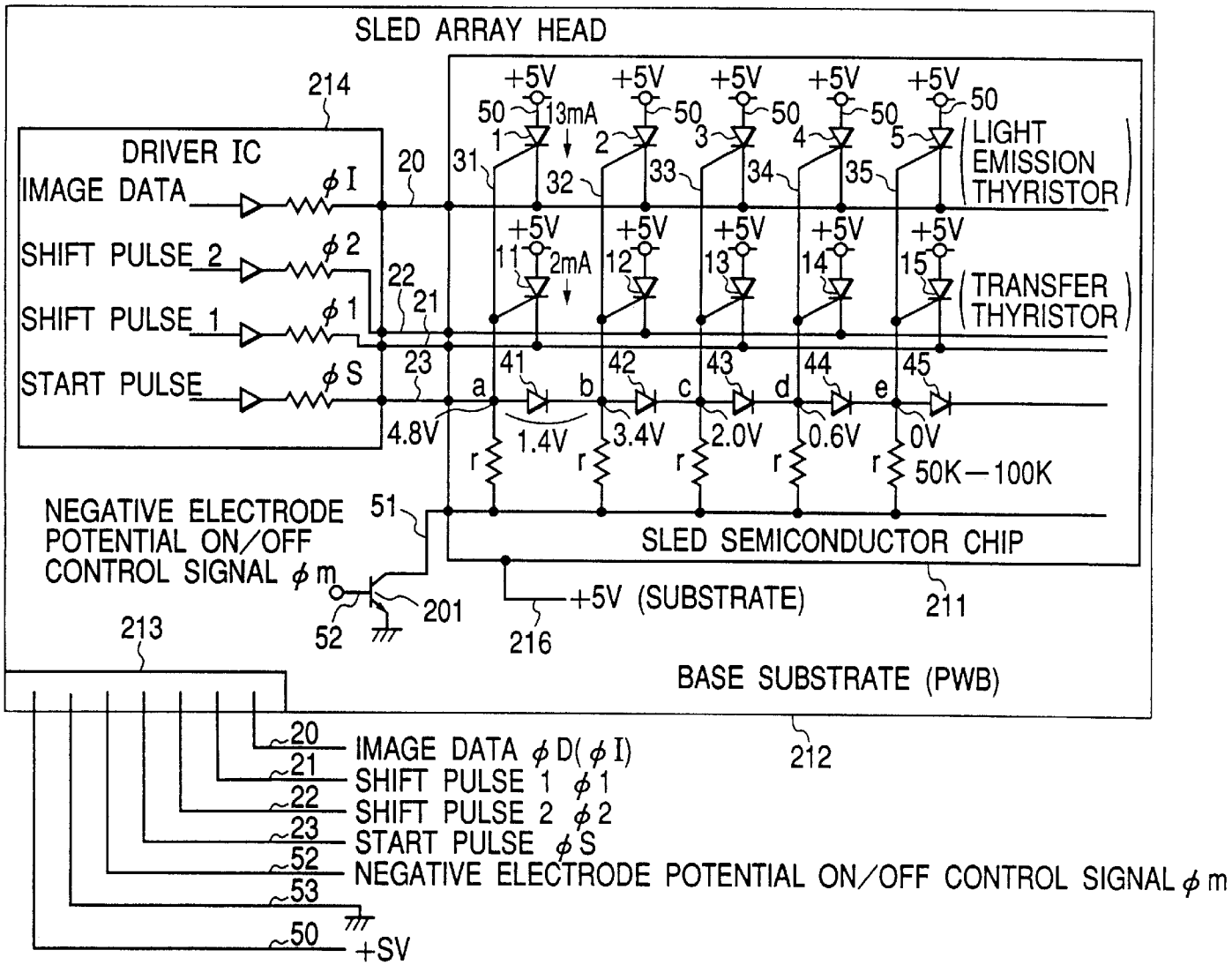
FIG. 1 is a block diagram showing the configuration of the SLED array head of a first embodiment of the present invention.

FIG. 1 shows a schematic configuration of a substrate mounting a self-scanning LED (SLED) array head of the present invention. FIG. 2 shows an enlarged circuit configuration of an SLED semiconductor chip 211. FIG. 3 shows the appearance of a substrate including an SLED array head.

Figure 2:
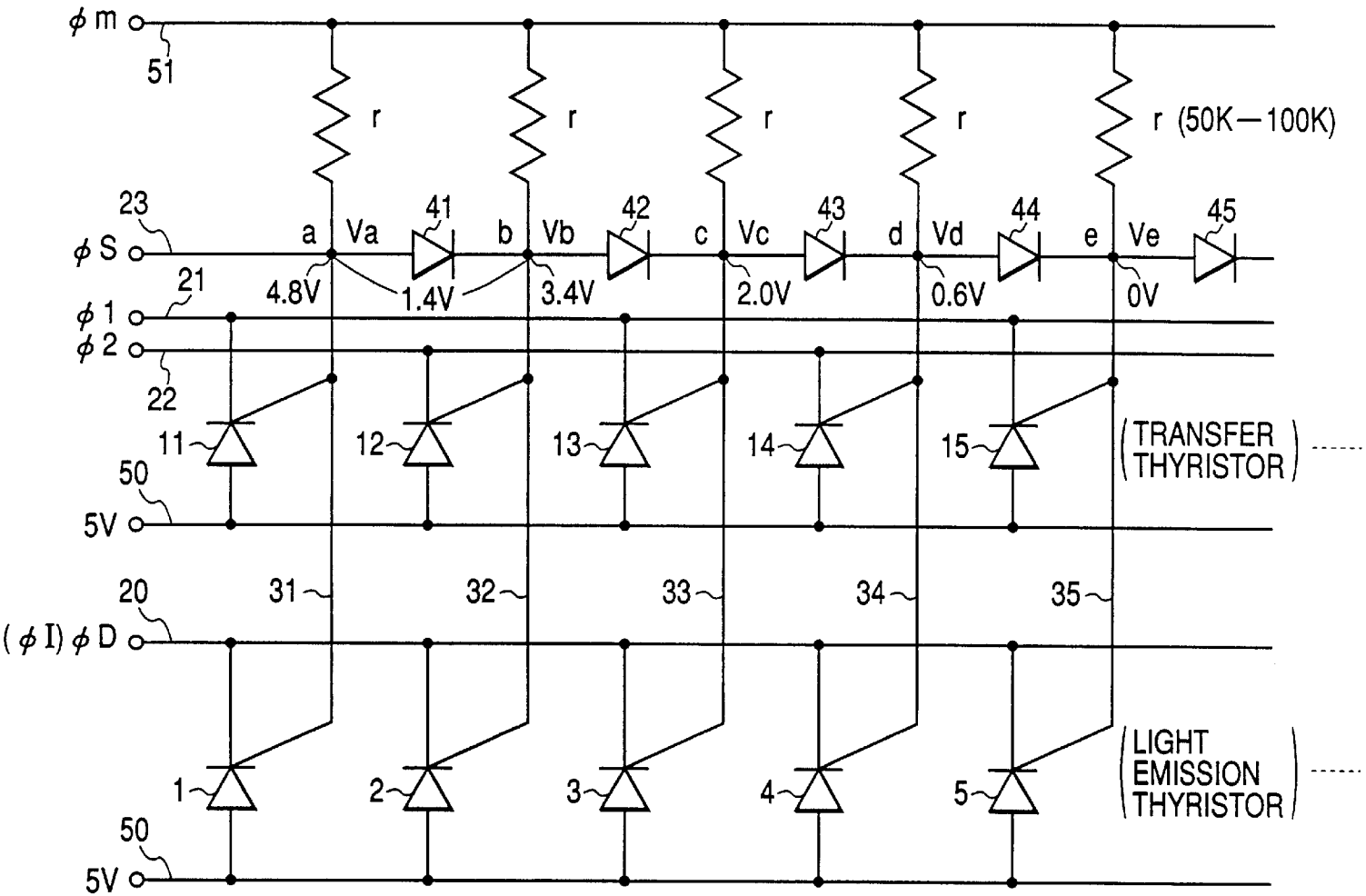
FIG. 2 is a circuit diagram showing the circuit configuration in an SLED semiconductor chip.

In FIGS. 1 and 2, symbol 211 denotes an SLED semiconductor chip.

In the SLED semiconductor chop 211, symbols 1 to 5 denote light-emitting thyristors serving as recording elements and 11 to 15 denote transfer thyristors.

As for the light-emitting thyristors 1 to 5, a +5V power-supply line 50 is connected to anodes and a connection line 20 to which image data $\phi$D and a control signal $\phi$I are inputted is connected to cathodes.

As for the transfer thyristors 11 to 15, the +5V power-supply line 50 is connected to the anodes and connection lines 21 and 22 to which shift pulses 1 and 2 serving as control signals $\phi$1 and $\phi$2 are inputted are connected to the cathodes.

Gate terminals of the light-emitting thyristors 1 to 5 are connected with gate terminals of the transfer thyristors 11 to 15 by connection lines 31 to 35 respectively. Diodes 41 to 45 are connected between the connection lines 31 to 35 in series.

A connection line 23 to which a start pulse ϕs is inputted is connected to a connection point "a" with a diode 41 of the connection line 31.

The connection lines 31 to 35 are connected with a connection line 51 to which a negative-electrode-potential on/off control signal ϕm is inputted. The connection line 51 is connected with the collector terminal of a switching element 201. A connection line 52 to which the negative-electrode-potential on/off control signal ϕm is inputted is connected to the base terminal of the switching element 201.

Symbol 212 denotes a base substrate for mounting the SLED semiconductor chip 211. The SLED semiconductor chip 211 is configured by a printed circuit board made of glass epoxy or ceramic.

Symbol 213 denotes a connector. The connector 213 connects with the connection line 52 for the negative-electrode-potential on/off control signal ϕm, connection lines 20 to 23 for the control signals ϕ1, ϕ2, ϕS, and ϕI, +5V power-supply line 50, and earth line 53.

Symbol 214 denotes a driver IC for receiving various control signals from external units and outputting these signals as control signals for driving the SLED semiconductor chip 211.

Figure 3:
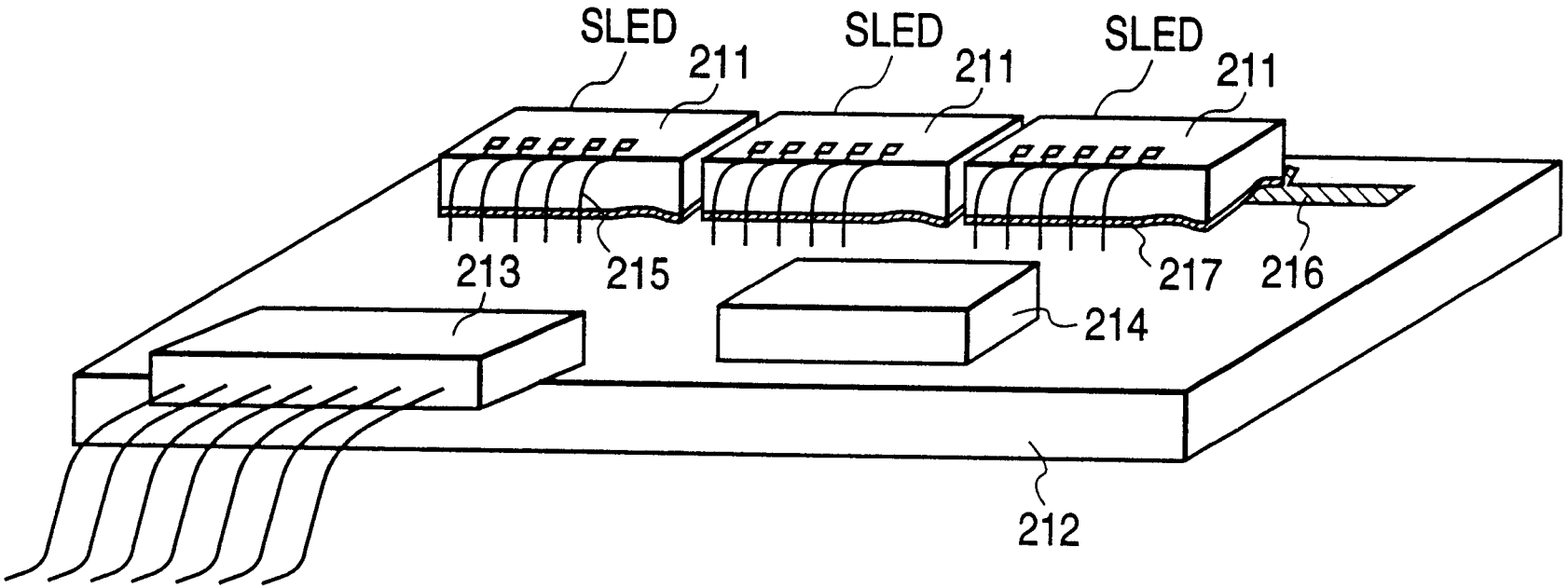
FIG. 3 is a perspective view showing the external configuration of an SLED array head.

In FIG. 3, symbol 215 denotes a bonding wire for connecting control signals (ϕ1, ϕ2, ϕS, and ϕI) outputted from the driver IC 214 and a negative-electrode-side power-supply input signal (as for this embodiment, GND supplied from the earth line 53) to an electrode formed on the surface of the SLED semiconductor chip 211.

Symbol 216 denotes a positive-electrode-side power-supply pattern (+5V as for this embodiment) extended to the base substrate 212.

Symbol 217 denotes silver paste for electrically connecting and bonding the positive-electrode-side power-supply pattern 216 extended to the base substrate 212 with the back-face electrode of the SLED semiconductor chip 211 and bonding to fix them.

(Circuit operations)

Then, circuit operations of an SLED array head will be described below.

Figure 4:
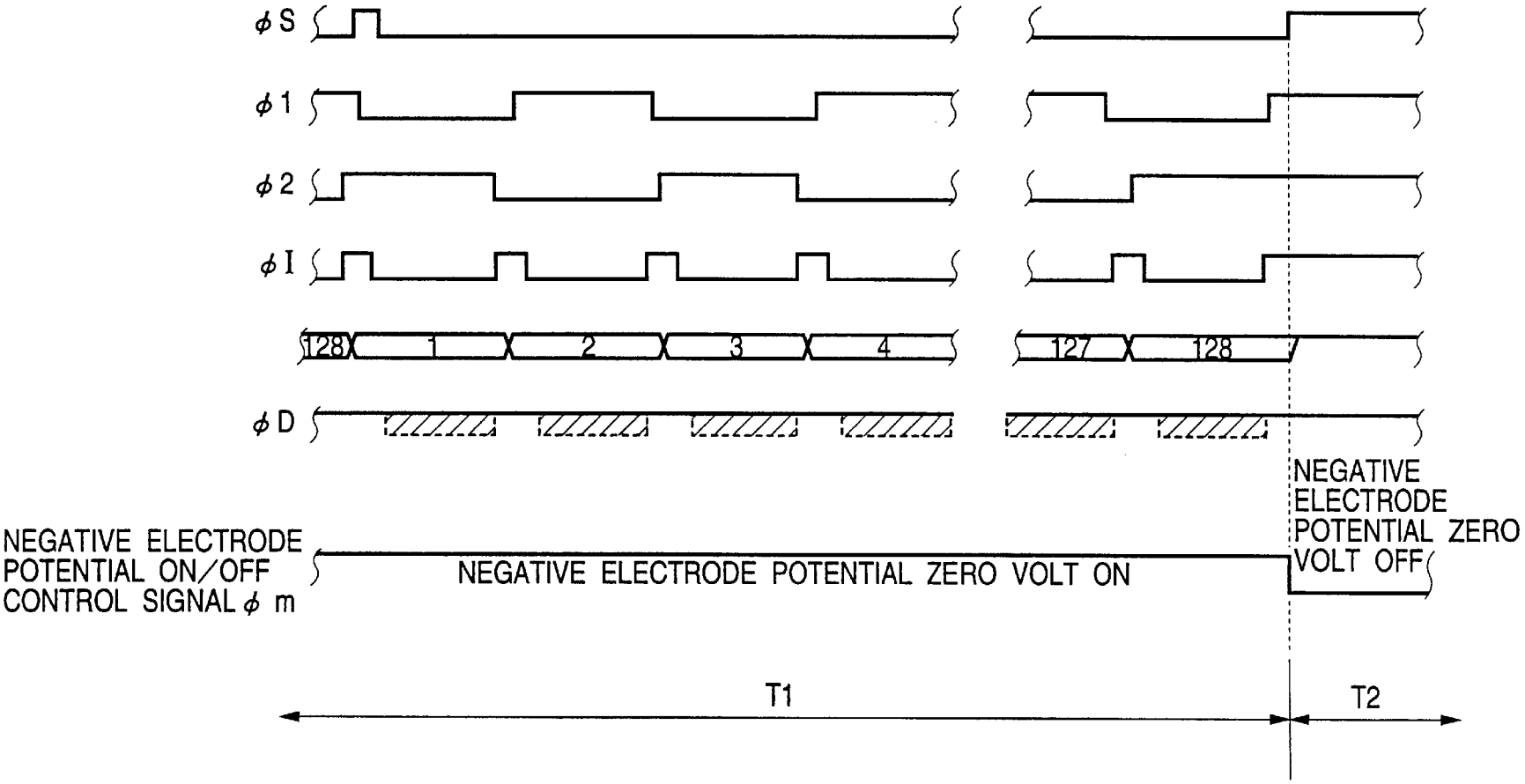
FIG. 4 is a timing chart showing the light-emitting operation of an SLED array head by dividing the operation into a section in which the operation is performed and a section in which the operation is not performed.

FIG. 4 shows operation timings of various control signals ϕ1, ϕ2, ϕS, and ϕI for controlling light emission and non-light emission of the light-emission thyristors 1 to 5 in the SLED semiconductor chip 211 and a negative-electrode-potential on/off control signal ϕm. The hatched region enclosed by broken lines shown by the waveform of the image data ϕD shows a state in which the light-emission thyristors 1 to 5 are turned on.

In FIG. 4, the portion of a section T1 is a waveform when the normal light-emitting or transfer operation is performed (detailed operations are described later). The portion of a section T2 corresponds to a predetermined period in which the light-emitting or transfer operation by an LED array is not performed and which is a feature of this embodiment.

As for this circuit, a control signal input unit (control signals ϕ1, ϕ2, ϕS, and ϕI) and a negative-electrode-side power-supply input unit (negative-electrode potential on/off control signal ϕm) are fixed to a potential or high-impedance state same as that of a positive-electrode-side power-supply input unit (power-supply voltage of +5V) in the predetermined section T2.

Specific operations will be described below.

The final portion of the section T1 denotes the timing of the final step of a series of light-emitting operations of a unit mounting an SLED array head. That is, the subsequent section denotes a state in which no light-emitting or transfer operation is requested.

The subsequent section T2 denotes a section of the present invention. In the section T2, the control signals ϕ1, ϕ2, ϕS, and ϕI are all fixed to +5V. Moreover, the negative-electrode-potential on/off control signal ϕm is set to 0V and input, the switching element 201 is turned off, and thereby, the negative-electrode-side power supply is opened.

By setting the above state, every signal and negative-electrode-side power supply connected to the epitaxial-layer-side face (element-forming face) of the SLED semiconductor chip 211 opposite to the substrate-side face (back-face electrode side) is set to a potential equal to that of the positive-electrode-side power supply of the substrate side or a floating state and thus, a state in which a bias is not applied between the substrate and the epitaxial-layer is configured.

Thereby, the conductive ion component of the silver paste 217 serving as a conductive adhesive for connecting the substrate of the SLED semiconductor chip 211 with the base substrate 212 of the chip 211 and fixing them is moved in the epitaxial-layer direction and thus, it is possible to prevent a phenomenon such as deposition from occurring.

Moreover, there is an application example of an LED array head that performs recording by mounting an SLED array head including the SLED semiconductor chip 211 on an image-forming unit according to an electrostatic electrophotographic system.

As for this type of image-forming unit, the ratio of the total standby time until the service life of the body expires to the actual working time of the body (that is, the time for an LED array head to actually emit light as optical writing means) is considerably large. Because the time ratio is considerably large, it is possible to control the time for depositing an ion component and thereby, it is possible to improve the deposition quantity based on the ion component up to a level at which no problem occurs in practical use.

Moreover, as shown in FIG. 4, this embodiment controls the negative-electrode-potential on/off control signal ϕm and the control signals ϕ1, ϕ2, ϕS, and ϕI so as to perform circuit operations. In case of this embodiment, the circuit configuration for generating these various signals is omitted. Basically, however, it is possible to execute a predetermined processing by using software means by a control program or hardware means by an arithmetic circuit such as a delay circuit and thereby, performing general control by a CPU.

Figure 5:
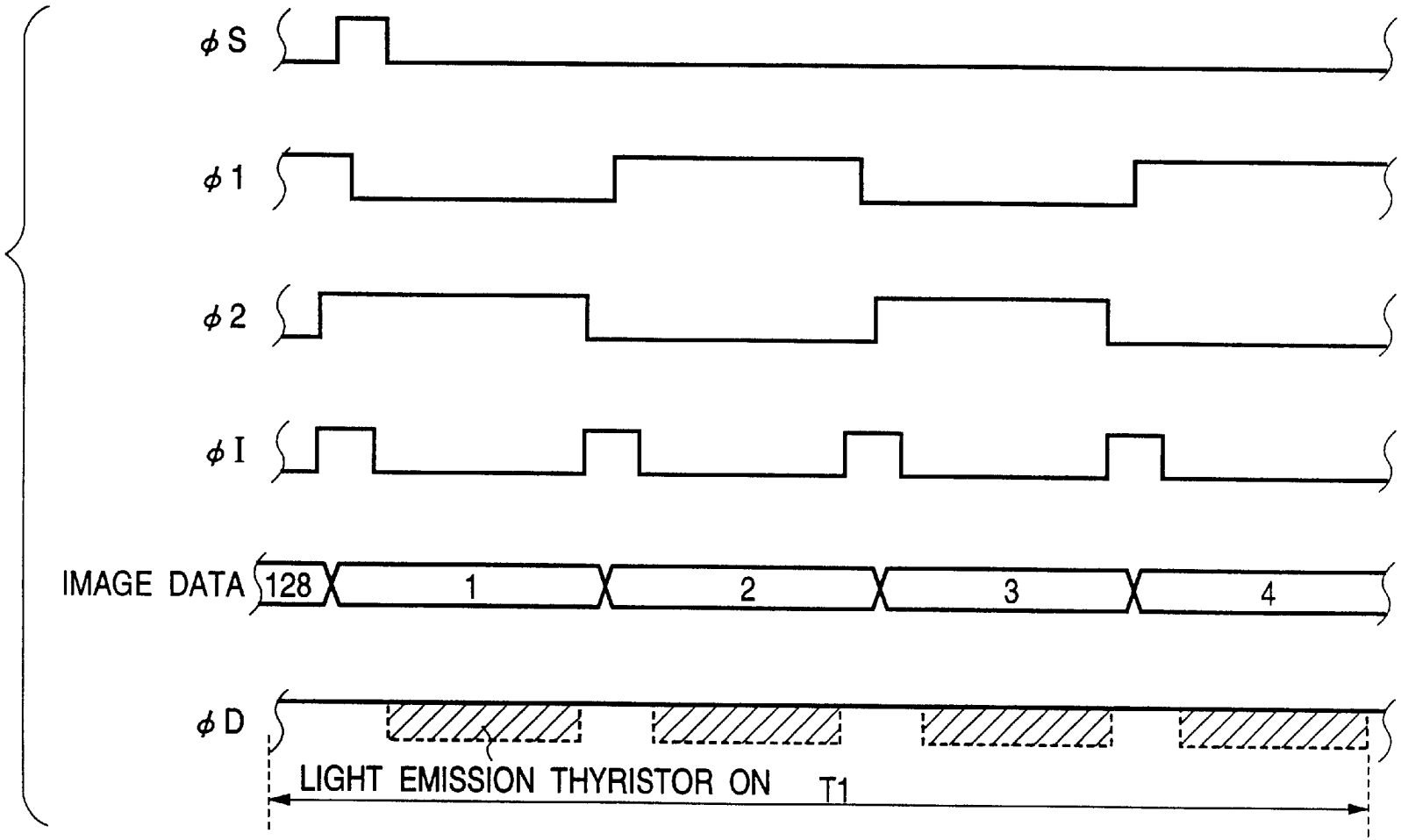
FIG. 5 is a timing chart showing the normal light-emitting operation of an SLED array head.

Then, the circuit operations in the section T1 shown in FIG. 4 (light-emitting operation and transfer operation by SLED array of circuit in FIG. 2) are described by referring to FIG. 5.

FIG. 5 shows control signals for controlling the SLED and their timings, which is an example when turning on every element.

As shown in FIG. 2, the SLED is configured by the transfer thyristors 11 to 15 arranged like an array and the light-emission thyristors 1 to 5 arranged like an array. Gates of the thyristors are connected each other and the first thyristor is connected to the ϕS-signal input unit. The gate of the second thyristor is connected to the cathode of the diode 41 connected to the ϕS terminal and the third thyristor is connected to the cathode of the next diode 42.

Transfer and light emission will be described below by referring to the timing chart of FIG. 5.

Transfer is started by changing ϕS from 0V to 5V. When ϕS is changed to 5V, Va is set to 5V, Vb is set to 3.7V (when assuming that the forward-directional voltage drop of a diode is 1.3V), Vc is set to 2.4V, Vd is set to 1.1V, and subsequently, voltage is set to 0V, and gate signals of the transfer thyristors 11 and 12 change from 0V to 5V and 3.7V respectively.

Under the above state, by changing ϕ1 from 5V to 0V, the potential of the anode of the transfer thyristor 11 is set to 5V, that of the cathode of it is set to 0V, that of the gate of it is set to 3.7V, thereby the on-condition of the thyristor is set, and thus the transfer thyristor 11 is turned on.

Under the above state, even if changing ϕS to 0V, Va is set to approximately 5V because the thyristor 11 is turned on (this is because a pulse is applied to ϕS through a resistance and when the thyristor is turned on, potentials of the anode and gate becomes almost equal). Therefore, even if setting ϕS to 0V, the on-condition of the first thyristor is kept and the first shift operation is completed.

Under the above state, by changing the signal ϕI for a light-emission thyristor from 5V to 0V, a condition same as that in which the transfer thyristor 11 is turned on is set. Therefore, the light-emitting thyristor 1 is turned on and a first LED lights up. As for the first LED, by returning ϕI to 5V, the potential difference between the anode and the cathode of the light-emission thyristor 1 decreases to 0 and thereby, the minimum holding current of the thyristor cannot be flown. Thus, the light-emission thyristor 1 is turned off.

Then, transfer conditions from the transfer thyristor 11 to the transfer thyristor 12 will be described below.

Even if the light-emission thyristor 1 is turned off, ϕ1 is kept at 0V and the transfer thyristor 11 is kept on. Therefore, the gate voltage Va of the transfer thyristor 11 is set to approximately 5V and the voltage Vb is set to 3.7V.

Under the above state, by changing ϕ2 from 5V to 0V, the potential of the anode of the transfer thyristor 12 is set to 5V, that of the cathode of it is set to 0V, and that of the gate of it is set to 3.7V, and the transfer thyristor 12 is turned on. By changing ϕ1 from 0V to 5V after the transfer thyristor 12 is turned on, the transfer thyristor 11 is turned off the same as the light-emission thyristor 1 is turned off. Thus, on-state is transferred from the transfer thyristor 11 to the transfer thyristor 12. Moreover, by changing ϕI from 5V to 0V, the light-emission thyristor 2 is turned on to emit light.

Only a light-emission thyristor can emit light while a transfer thyristor is turned on because, unless the transfer thyristor is turned on, gate voltages of thyristors except a thyristor next to a turned-on thyristor are set to 0V and therefore, on-condition of thyristors is not set. Moreover, the thyristor next to the turned-on thyristor is not turned on because the light-emission thyristor is turned on, thereby the potential of ϕI is set to 3.4V (equivalent to the forward voltage drop of the light-emission thyristor), and the potential difference between the gate and the cathode of the thyristor next to the turned-on thyristor decreases to 0.

[Second embodiment]

Then, the second embodiment of the present invention will be described below by referring to FIGS. 6 and 7. However, description of a portion of this embodiment same as that of the above first embodiment is omitted and provided with the same symbol.

Figure 6:
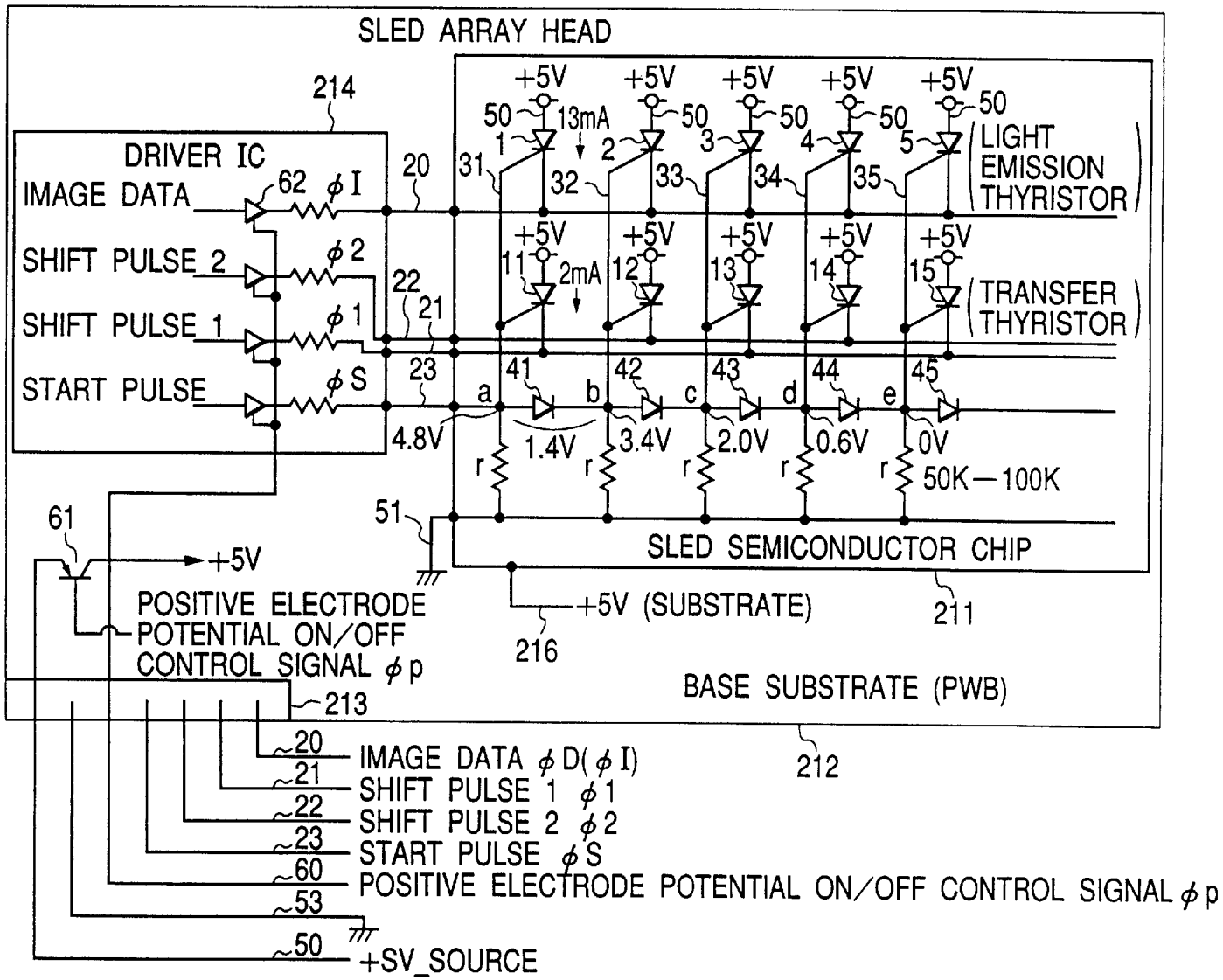
FIG. 6 is a block diagram showing the configuration of the SLED array head of a second embodiment of the present invention.

FIG. 6 shows a schematic configuration of a substrate mounting an SLED array head of the present invention.

As for an SLED semiconductor chip 211, a connection line 51 is connected to the earth. Other configuration is the same as that of the first embodiment above described.

A control line 60 for inputting a positive-electrode-potential on/off control signal ϕp is connected to a connector 213. The control line 60 is connected to the gate terminal of a switching element 61 and each three-state buffer 62 in a driver IC 214.

As for this embodiment, the positive-electrode-potential on/off control signal ϕp substitutes for the negative-electrode-potential on/off control signal ϕm.

(Circuit operations)

Circuit operations will be described below.

Figure 7:
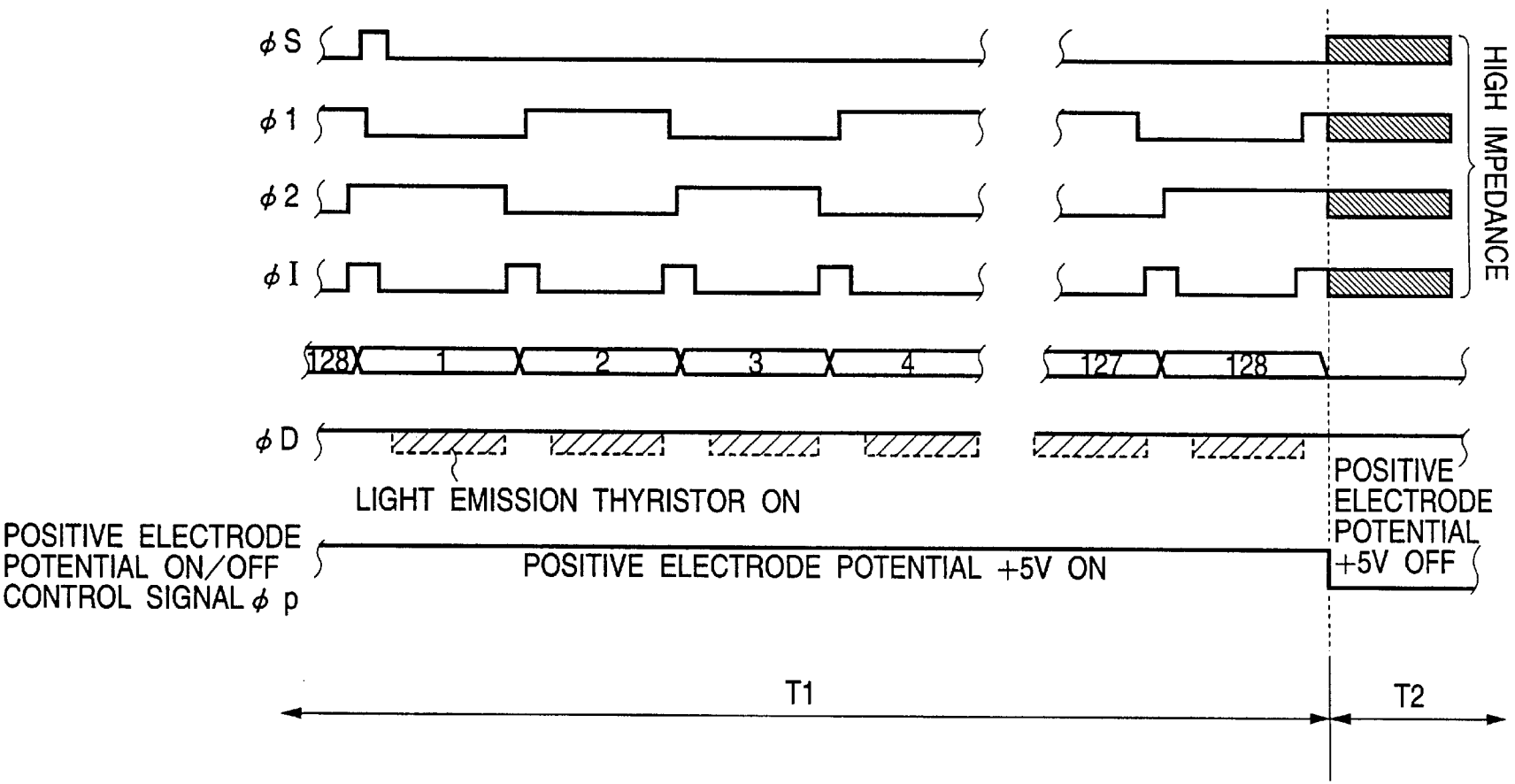
FIG. 7 is a timing chart showing the light-emitting operation of an SLED array head by dividing the operation into a section in which the operation is performed and a section in which the operation is not performed.
Figure 8:
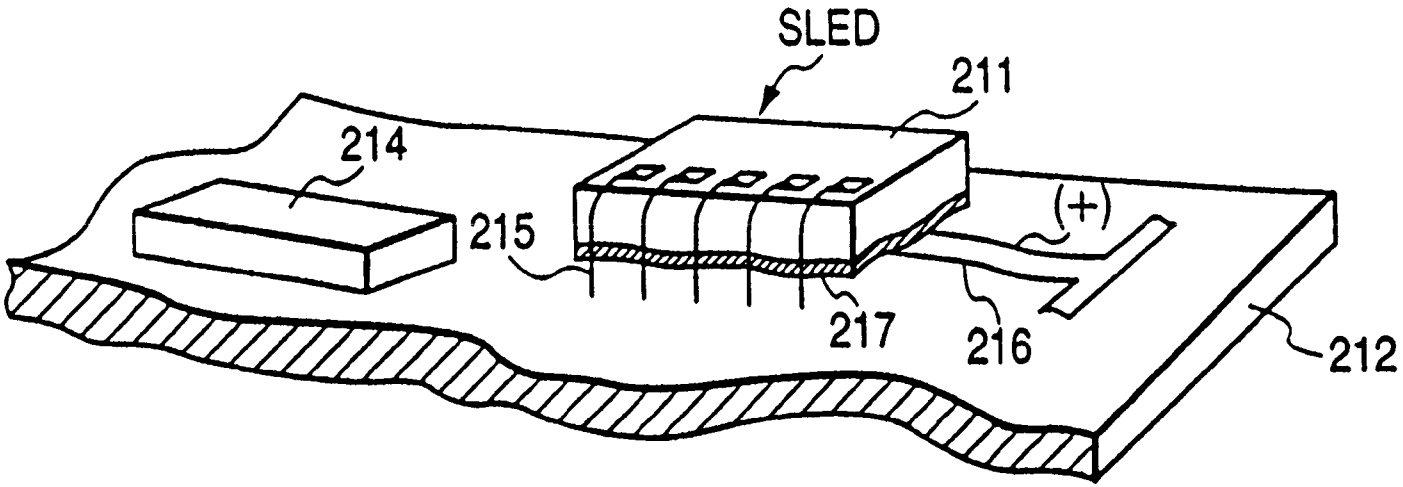
FIG. 8 PRIOR ART
FIG. 8 is a perspective view showing the external configuration of a conventional SLED array head.

FIG. 7 shows operation timings of the control signals ϕ1, ϕ2, ϕs, and ϕI, and the positive-electrode-potential on/off control signal ϕp for controlling light emission and non-light emission of the light-emission thyristors 1 to 5 in the SLED semiconductor chip 211.

In FIG. 4, the portion of the section T2 corresponds to a predetermined period in which the light-emitting operation or transfer operation is not performed by an LED array and which is a feature of this embodiment. The portion of the section T1 shows a waveform while the normal light-emitting or transfer operation is performed, which is the same as the example above described.

As for this circuit, the control signal input unit (ϕ1, ϕ2, ϕS, and ϕI), positive-electrode power-supply input unit (positive-electrode-potential on/off control signal ϕp), and negative-electrode power-supply input unit (GND) are set to the same potential or high-impedance state in the predetermined section T2.

Specific operations will be described below.

The section T1 is a section when the normal light-emitting or transfer operation is performed. The portion of the section T1 is assumed as the timing of the final step of a series of light-emitting operations of a unit mounting an SLED array head. That is, thereafter, a state in which next light-emitting or transfer operation is not requested is kept.

The section T2 following the section T1 is a section in which characteristic operations of this embodiment are performed. In this case, the control signals ϕ1, ϕ2, ϕS, and ϕI are turned off by turning off the three-state buffer 62 in accordance with the positive-electrode-potential on/off control signal ϕp corresponding to the disabling notice of an enable signal supplied from an external unit. Moreover, the positive-electrode-side power supply (+5V) is simultaneously turned off by turning off the switching element 61 in accordance with the positive-electrode-potential on/off control signal ϕp.

By setting the above state of the section T2, every signal connected to the epitaxial-layer-side face (element-forming face) of the SLED semiconductor chip 211 is set to a high-impedance state. Moreover, because the portion between the negative and positive electrodes is set to zero volt, a state in which no bias is applied between the substrate and the epitaxial-layer is configured.

Thereby, it is possible to prevent the probability of the phenomenon that the conductive ion component of the sliver paste 217 moves in the epitaxial-layer direction between the substrate of the SLED semiconductor chip 211 and the base substrate 212 and is deposited.

The above embodiments were described by using an SLED array. However, the embodiments are not restricted to the SLED array. It is possible to obtain the same advantage by using other light-emitting element (recording element).

As for the above embodiments, every control signal and a negative-electrode-side power-supply input unit are set to a potential or high-impedance state same as that of a positive-electrode-side power-supply input unit in a predetermined period in which the light-emitting or transfer operation is not performed by a light-emitting element or every control signal, the positive-electrode-side power-supply input unit, and the negative-electrode-side power-supply input unit are the same potential of high-impedance state. Therefore, because no bias is applied between the epitaxial-layer and the substrate of a semiconductor chip while a head including a light-emitting element is not actually operated, it is possible to produce conductive deposit only when the head is actually operated even if using a conductive adhesive containing positive ions such as sliver paste for connection and fixing and keep the deposit quantity at a level in which there is no problem for practical use when the actual operation time is short enough compared to a standby period.

It is apparent that not only the above embodiments but also various modifications can be considered as the configuration for controlling a power supply and control signals supplied from the electrode on the back face and electrodes on other faces of a semiconductor chip by various methods so that no electric field is generated between the electrode on the back face and the electrodes on other faces of the semiconductor chip.

(Example of application to image recording apparatus)

Then, an image recording apparatus for recording an image through an electrophotographic system by using an SLED array head described for the above embodiments will be described below in detail.

Figure 9:
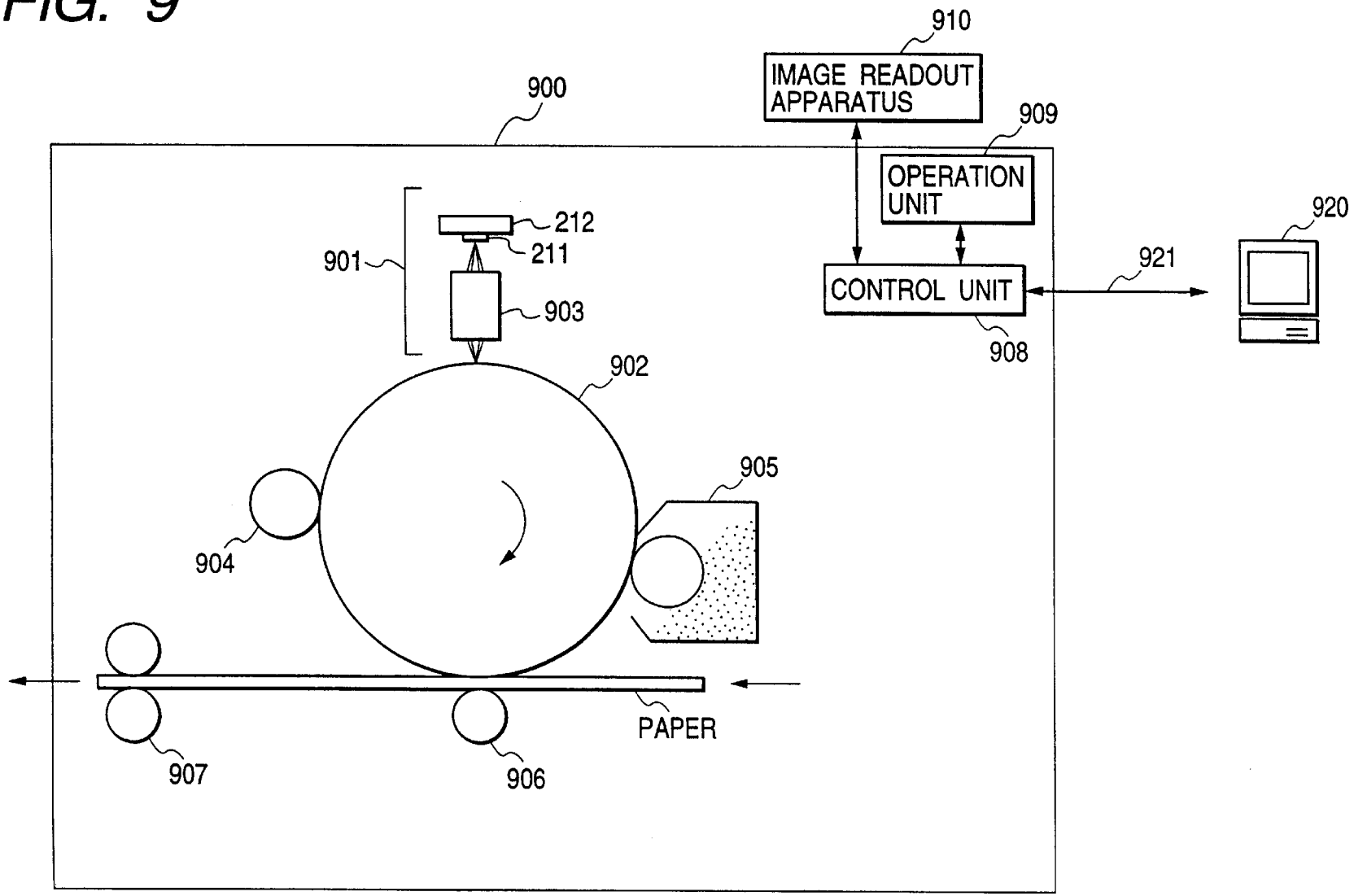
FIG. 9 is an illustration of an image recording apparatus.

FIG. 9 is a sectional view of the image recording apparatus. Because the configuration and control operations of the SLED array head were previously described, other portions will be described below. In FIG. 9, symbol 212 denotes the above-described base substrate on which an SLED chip 211 is mounted. The light-emitting unit of the SLED chip 211 is turned downward in FIG. 9. Symbol 902 denotes a photosensitive body rotating in the direction of the arrow and 903 denotes a self-focusing lens array. The lens array 903 records an electrostatic latent image on the photosensitive-body drum 902 by focusing a luminous flux emitted from the SLED chip 211 on the faced photosensitive-body drum 902. The base substrate 212 and the lens array 903 are integrated as a removable cartridge and the cartridge including the base substrate 212 and the lens array 903 may be referred to as an SLED array head 901.

Moreover, symbol 904 denotes a primary electrification roller for uniformly electrifying the surface of the photosensitive-body drum 902 before exposure by the SLED array head 901 and 905 denotes a development counter for developing an electrostatic latent image recorded on the photosensitive-body drum 902 with toner by the SLED array head 901, 906 denotes a transfer roller for transferring the toner image recorded by the development counter 905 onto a transfer form, and 907 denotes a fixing unit for fixing the toner image on the transfer sheet.

Furthermore, each section in the image control unit is controlled by a control unit 908. An operation unit 909 is used for an operator to supply a command for starting an image recording job or the like to an image recording apparatus 900.

Furthermore, an image readout apparatus 910 is connected as the external unit of the image recording apparatus 900 and moreover connected with a host computer 920 through a network 921. Thereby, the image recording apparatus 900 can execute various image recording jobs on an image read by the image readout apparatus 910 or languaged image information to be sent from the host computer.

It is possible to independently set the operation unit 909 outside of the image recording apparatus 909 or inside of the image readout apparatus 910.

Then, the timing will be specifically described below at which the above-described section T2 is controlled to execute an image recording job, by referring to the time charts of FIGS. 10A and 10B.

Figure 10A:
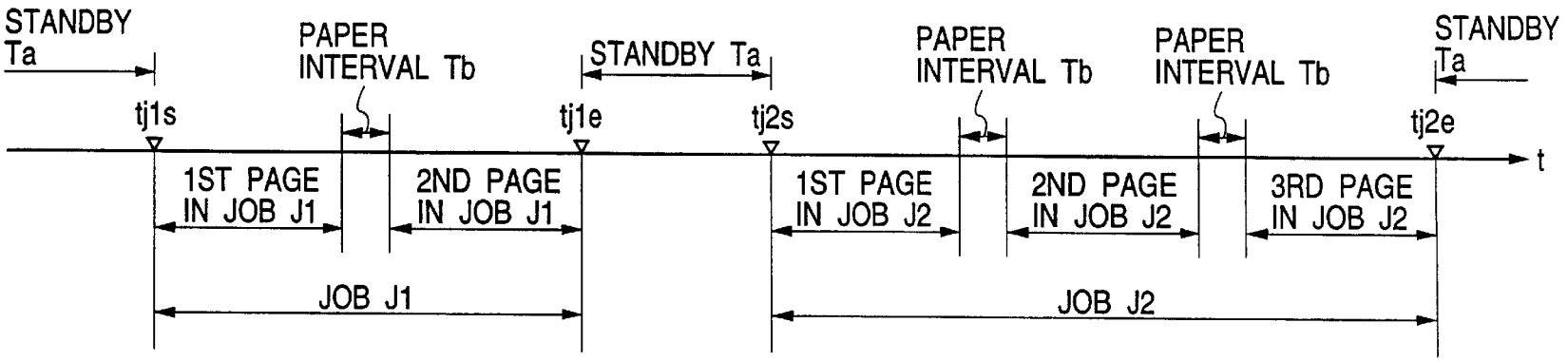
FIGS. 10A and 10B are time charts showing an image recording apparatus.

FIG. 10A shows a case of performing an image recording job J1 for two pages and an image recording job J2 for three pages. In FIG. 10A, symbol tj1s denotes the timing when the image recording job J1 is started, tj1e denotes the timing when the image recording job J1 is ended, tj2s denotes the timing when the image recording job J2 is started, and tj2e denotes the timing when the image recording job J2 is ended. In this time chart, the above section T2 is controlled at the timing of standby Ta between the image recording jobs (that is, in a period between tj1e and tj2s).

In other words, the control unit 908 executes the control of the above section T2 during the standby between the image recording jobs and thereafter, changes the mode to the control of the above section T1 to execute an image recording job synchronously with an image-recording-jog start command supplied from the operation unit 909 or host computer 920. Moreover, the control unit 908 changes the mode to the control of the above section T2 again after the image recording job is completed.

Furthermore, it is preferable to perform the control of the above section T2 also at the timing of the paper interval Tb between sheets present in each job.

Figure 10B:
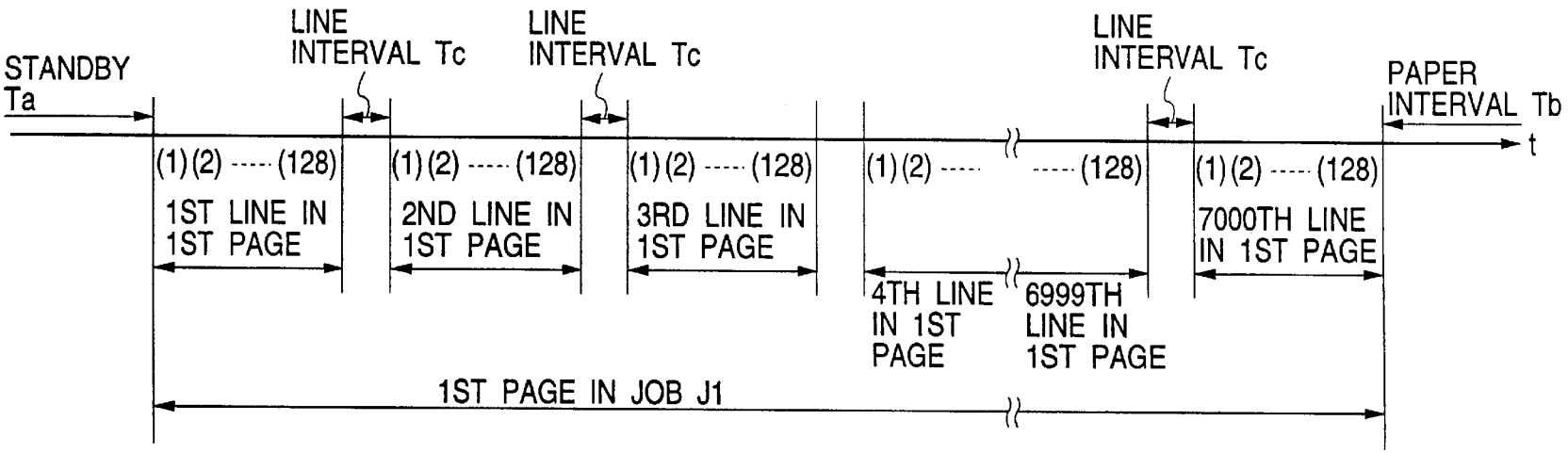

FIG. 10B shows a detailed timing chart while the image on each page is recorded. In FIG. 10B, it is more preferable to perform the control of the above section T2 at the timing of line interval Tc between line recording and line recording while each image is recorded.

This embodiment makes it possible to record data on a recording medium such as a photosensitive body by mounting the above head on an electrophotographic image recording apparatus as a recording head and thereby, it is possible to fabricate a recording apparatus having less electrical troubles and a high reliability when recording operation is performed.

As for the above embodiments, a configuration is described in which the positive potential of a power supply is supplied from the electrode on the back-face side of a semiconductor chip and the negative potential of the power supply and control signals are supplied from electrodes on the other face sides. It is only a design matter to input any power-supply potential and any control signal from any face. It is apparent from the above embodiments that any configuration can be applied so as to prevent the probability of electric fields occurring between the electrode on the back face and electrodes on other faces.

Moreover, as for the above embodiments, a case is described in which an SLED array chip is used as a semiconductor chip. However, the present invention is not restricted to the above case. It is apparent that the present invention can be applied to a recording-element array chip other than a light-emitting-element array chip and moreover, various semiconductor chips other than a semiconductor chip used for recording.

Furthermore, it is apparent that the present invention can be applied to various types of apparatuses including a display in addition to the fact that an image recording apparatus is configured by using the above semiconductor chip.

The present invention was described above by using some preferred embodiments. However, the present invention is not restricted to these embodiments. It is apparent that various modifications and applications of the present invention are possible in the scope of claims.

What is claimed is:

1. An image recording apparatus comprising:

a recording element chip, which consists of a semiconductor chip having first electrodes on a back face and second electrodes on the other face, the first electrodes connecting to a power supply pattern on a base substrate by a conductive adhesive which contains ions and the second electrodes connecting to bonding wires;

inputting means for (i) inputting a positive potential of a power supply to said recording element chip through the first electrodes on the back face of said recording element chip via the conductive adhesive, and (ii) inputting a negative potential of the power supply and a control signal to said recording element chip through the second electrodes on the other face of said recording element chip via the bonding wires; and setting means for (i) setting the positive potential of power supply input to the first electrodes on the back face of the recording element chip and the negative potential of the power supply input to the second electrodes on the other face of said recording element chip to the same potential and for (ii) setting the control signal input to the second electrodes to a high impedance or the same potential as that of the positive potential of power supply input to the first electrodes, in a predetermined period in which said recording element chip is not driven.

2. An apparatus according to claim 1, further comprising switching means for connecting or disconnecting one of the positive potential and the negative potential of the power supply in the predetermined period.

3. An apparatus according to claim 1, wherein said recording element chip is fixed on the base substrate by the conductive adhesive.

4. An apparatus according to claim 1, wherein the conductive adhesive contains positive ions.

5. An apparatus according to claim 1, wherein the back face is the substrate side of the semiconductor chip.

6. An apparatus according to claim 1, wherein the other face is the epitaxial layer side of the semiconductor chip.

7. An apparatus according to claim 1, wherein a plurality of recording elements are arranged as an array on said recording element chip.

8. An apparatus according to claim 7, wherein the control signal includes a two-phase pulse signal and successively turns on the recording elements in accordance with the two-phase pulse signal.

9. An apparatus according to claim 7, wherein the recording elements each comprise a light-emitting element.

10. An apparatus according to claim 9, further comprising a recording medium comprising a photosensitive body for recording an image through an electrophotographic system.

11. An apparatus according to claim 9, wherein each light-emitting element is a light-emission thyristor.

12. An apparatus according to claim 11, wherein the semiconductor chip further includes transfer thyristors corresponding to each light-emission thyristor and light-emission and non-light emission of the light-emission thyristor is controlled by the transfer thyristor.

13. An apparatus according to claim 12, wherein the control signal includes a two-phase pulse signal and a transfer thyristor and light-emission thyristor are successively turned on in accordance with the two-phase pulse signal.

14. An apparatus according to claim 1, wherein the predetermined period is a standby period between an image recording job and the next image recording job.

15. An apparatus according to claim 1, wherein the predetermined period is a period between pages in one job.

16. An apparatus according to claim 1, wherein the predetermined period is a period between line recordings in one page.

17. An image recording apparatus control method for controlling a recording element chip, which consists of a semiconductor chip having first electrodes on a back face and second electrodes on the other face, the first electrodes connecting to a power supply pattern on a base substrate by a conductive adhesive which contains ions and the second electrodes connecting to bonding wires, the method comprising the steps of:

inputting a positive potential of a power supply to said recording element chip through the conductive adhesive;

inputting a negative potential of the power supply and a control signal to said recording element chip through the second electrodes on the other face of said recording element chip via the bonding wires;

setting the positive potential of power supply input to the first electrodes on the back face of said recording element chip and the negative potential of power supply input to the second electrodes on the other face of said recording element chip to the same potential, in a predetermined period in which the recording element chip is not driven; and setting the control signal input to the second electrodes to a high impedance or the same potential as that of the positive potential of power supply input to the first electrodes, in the predetermined period.

18. A method according to claim 17, wherein the predetermined period is a standby period between an image recording job and the next image recording job.

19. A method according to claim 17, wherein the predetermined period is a period between pages in one job.

20. A method according to claim 17, wherein the predetermined period is a period between line recordings in one page.

21. A method according to claim 17, wherein a plurality of recording elements are arranged as an array on said recording element array chip.

22. A method according to claim 21, wherein the recording elements each comprise a light-emitting element.

23. A method according to claim 22, wherein a recording medium comprising a photosensitive body is used for recording an image through an electrophotographic system.

* * * * *